US006497257B1

(12) United States Patent
Allen et al.

(10) Patent No.: US 6,497,257 B1
(45) Date of Patent: Dec. 24, 2002

(54) CONTROL OF FILL YARN DURING BASKET WEAVE TYPE PATTERNS ON AIR JET LOOMS

(75) Inventors: Tony L. Allen, Burnsville; Farrell V. Hedrick, Green Mountain, both of NC (US)

(73) Assignee: Glen Raven, Inc., Glen Raven, NC (US)

( * ) Notice: Subject to any disclaimer, the term of this patent is extended or adjusted under 35 U.S.C. 154(b) by 46 days.

(21) Appl. No.: 10/085,270

(22) Filed: Feb. 28, 2002

(51) Int. Cl.[7] ..... D03D 47/30

(52) U.S. Cl. ..... 139/450; 139/11; 139/440; 139/435.1

(58) Field of Search ..... 139/11, 116.1, 139/435.1, 435.2, 435.3, 435.4, 435.5, 435.6, 440, 450

(56) References Cited

U.S. PATENT DOCUMENTS

| | | | | | |
|---|---|---|---|---|---|
| 3,633,808 | A | | 1/1972 | Svaty | 226/97 |
| 4,326,565 | A | | 4/1982 | Van Mullkom | 139/435 |
| 4,367,772 | A | | 1/1983 | Wall | 139/435 |
| 4,644,980 | A | | 2/1987 | Mitsuya et al. | 139/435 |
| 4,691,745 | A | | 9/1987 | Takekawa et al. | 139/435 |
| 4,813,460 | A | * | 3/1989 | Van Bogaert et al. | 139/435.4 |
| 4,936,353 | A | * | 6/1990 | Volland et al. | 139/194 |
| 5,016,679 | A | * | 5/1991 | Cox | 139/194 |
| 5,018,557 | A | * | 5/1991 | Fourneaux | 139/435.1 |
| 5,111,852 | A | * | 5/1992 | Verhulst | 139/435.4 |
| 5,127,445 | A | * | 7/1992 | Kakehashi | 139/1 R |
| 5,697,405 | A | | 12/1997 | Dornier et al. | 139/435.4 |
| 5,816,296 | A | | 10/1998 | Schuster | 139/450 |
| 6,109,309 | A | * | 8/2000 | Dornier et al. | 139/435.3 |
| 6,223,783 | B1 | | 5/2001 | Peeters et al. | 139/435.4 |

OTHER PUBLICATIONS

Photograph showing a right rear perspective view of a conventional air nozzle of the type described in the Background portion of the Specification, used on a Picanol loom, Picanol N.V., date unknown, known to be prior art.

* cited by examiner

*Primary Examiner*—A Vanatta
*Assistant Examiner*—Robert Muromoto, Jr.
(74) *Attorney, Agent, or Firm*—Womble Carlyle Sandridge & Rice, PLLC

(57) ABSTRACT

A fill yarn holding apparatus for use on an air jet loom of the type used for weaving certain fabric patterns where each pattern has at least two fill yarns introduced between each harness reciprocation, and including a pivotal sley shaft, a reed mounted on the sley shaft, at least one air jet for propelling fill yarns across the length of the reed, after which the reed beats the successive fill yarns against the fell line of the fabric being woven, and the harnesses cross to lock in the weave pattern. The fill yarn holding apparatus includes at least one holding air nozzle mounted on the sley shaft of the loom, the holding air nozzle having an opening formed and positioned to direct a jet of air against the previously laid fill yarn transversely to the path of the fill and toward the fell line, and wherein when the air jet propels a fill yarn, the holding air nozzle operates at a selected time to discharge air against the fell line to hold the fill yarn in place until the reed beats up to create a uniform weave pattern.

11 Claims, 6 Drawing Sheets

CONTROL OF FILL YARN DURING BASKET WEAVE TYPE PATTERNS ON AIR JET LOOMS

FIELD OF THE INVENTION

The present invention relates generally to nozzle configurations for air jet looms and, more particularly, to a nozzle for holding fill yarns in place where multiple parallel fill yarns form each weave pattern.

BACKGROUND OF THE INVENTION

Air jet looms have been in use in the textile industry for a number of years. In operation, these shuttleless looms form woven fabric in much the same manner as other looms, except that one or more air jets are used to propel the fill yarns across the shed. These looms-also typically employ several auxiliary air nozzles that are spaced apart in the shed of the warp yarns to aid in transporting a fill yarn along a straight path to the opposite side of the loom. In operation, an air jet propels the leading end of the fill yarn with a directed stream of air. Once the fill yarn reaches the other side, it is detected by a feeler head, or electronic eye. The reed of the loom then beats the fill yarn up against the fell line. The loom's two harnesses, that are conventional in any type of loom, cross one another, closing, and then opening a new shed, and thus locking the fill yarn into the woven fabric. Few problems arise with this woven construction which uses only a single fill yarn between each reciprocation of the harnesses, and the woven fabric is very uniformly formed. Unfortunately, this is not the case with yarn constructions in which two or more fill yarns are introduced between harness reciprocations, sometimes referred to as "basket weave" patterns.

Basket weave patterns are formed in a somewhat different fashion. A first fill yarn is propelled through the shed and beaten up against the fell line by the reed that moves forward with each fill cycle. As the reed pivots rearwardly away from the fell line, the harnesses do not cross as in the single fill weave construction. Rather, at least one additional fill yarn is propelled through the same open shed to complete the 2×2, 3×3, etc. pattern. Since the harnesses do not cross until the entire set of parallel fill yarns have been propelled across the loom, the fill yarns tend to be pulled back with the reed as the reed moves rearwardly away from the fell line. The extent to which this occurs is dependent on the number of fill yarns and type of yarn being woven. Sized synthetic yarns such as polyester and nylon have "slicker" surfaces that are more susceptible to this phenomenon, particularly where they have flat geometries. Because of this pull-back, the second fill yarn frequently crosses over the first, creating a loop, or rollover, of the two fill yarns. This results in a defect in the form of a woven fabric that has a non-uniform woven structure, an unacceptable appearance where the fill yarns of different colors are used in the weave, and does not meet a customer's quality standards. Simply, the woven fabric is not marketable and cannot be sold.

It is known in the art to place auxiliary nozzles along the length of the sley shaft in front of the reed to aid in transporting the fill yarn in a straight path to the opposite side of the loom. The nozzles, sometimes referred to as "shower head" nozzles, however, are directed parallel to the path of the fill yarn, but provide no assistance in holding fill yarns firmly against the fell line.

SUMMARY OF THE INVENTION

The present invention is directed to the use of one or more "holding nozzles" for fill yarns in an air jet loom that operate synchronously with the introduction of the fill yarns to address the problems described above. As used herein, a "holding nozzle" is an air nozzle placed in the shed of the loom and directed perpendicularly toward the previously deposited fill yarn. The holding nozzle(s) hold parallel fill yarns of a pattern set in position against the fell line on an air jet loom so that "loops", or "rollovers", between individual fill yarns will not occur, distorting the fabric and rendering it commercially worthless. As used herein a "pattern set" refers to the total number of yarns that comprise each pattern; e.g., a total of 2 in a 2×2 pattern. One or more of the nozzles may be installed on any air jet loom of the type having a sley shaft or other pivotal axle, a reed, and at least one air jet for propelling fill yarns through the shed formed by the harnesses of the loom.

In a preferred embodiment, one or more holding nozzles are mounted on the sley shaft, or at any other workable position within the shed of the loom. Each holding nozzle includes a tube mounted in or on a holder. The shape and size of the tube holder is not a critical aspect of the construction of the holding nozzle; the tube holder serves only as a mounting platform for the tube. A tube having an air intake end, a closed end, and an aperture formed at a selected point along the length of the tube, is secured in the holder. While the tube is desirably a single piece for ease of fabrication, it may be comprised of multiple pieces so long as it performs the intended function described herein. While a "tube" normally refers to a cylindrical, hollow member, the term as used herein refers to other shapes as well. For example, many conventional tubes, as that term is used in the textile art, have cross-sections that are oval or have flat sides and rounded ends, such as shower head tubes. Shape is critical; the important aspect is that these hollow members have geometries and an aperture located to direct a stream of air at a selected position on the fell line.

When each holding nozzle is properly positioned, the aperture directs a jet of air transversely against the previous fill yarn, and perpendicular to the fell line. After each of the air jets fires a fill yarn, the aperture discharges air against the fell line to hold the fill yarn in place until the reed beats up against the fell line and the loom's harnesses cross to lock in the weave pattern.

In the operation of forming a 2×2 basket weave pattern, for example, the weave construction begins by a first air jet firing a first fill yarn across the front of the reed through the open shed formed by the harnesses. The sley shaft of the loom then rotates, pivoting the reed to the fell line of the woven fabric where the fill yarn is beaten-up, or packed, against the edge of the fabric just formed. Certain yarn materials, such as multi-filament polyesters and nylons, tend to be "slick", and thus slide easily over like yarns. Thus in a basket or other similar weave pattern in which the previous fill yarn is not locked in place, there is a tendency for the first fill yarn to "pull-back" from the fell line with the reed, when the reed retreats rearwardly, for the next fill cycle in the weaving process.

After the first fill yarn is fired and detected on the opposite side of the loom (by sensors or electronic eyes known in the art), the reed beats up against the fell line and then pivots rearward. At a predetermined time during the rearward movement of the reed, the holding nozzles of the present invention begin discharging air to hold the first yarn in place against the fell line. The nozzle discharge continues until the subsequent fill yarns in the fill pattern have been fired and beaten up by the reed. Thus, in a 2×2 weave, the nozzles will begin blowing with the retreat of the reed following beatup of the first fill yarn and continue to direct air toward the fell line until beating up of the second fill yarn is complete and the harnesses have crossed, locking the fill yarns in place in the woven fabric.

The number of holding nozzles installed within the shed is dependent upon the length of the reed, the type of yarn selected for the application, and the placement of other auxiliary nozzles within the shed. In the Picanol loom described herein, a minimum of 3 nozzles interspaced between the auxiliary nozzles was found to be adequate for the holding function along the length of the fell line.

These and other aspects of the present invention will become apparent to those skilled in the art after a reading of the following description of the preferred embodiment when considered with the drawings.

DESCRIPTION OF THE PREFERRED EMBODIMENTS

Figure 1:
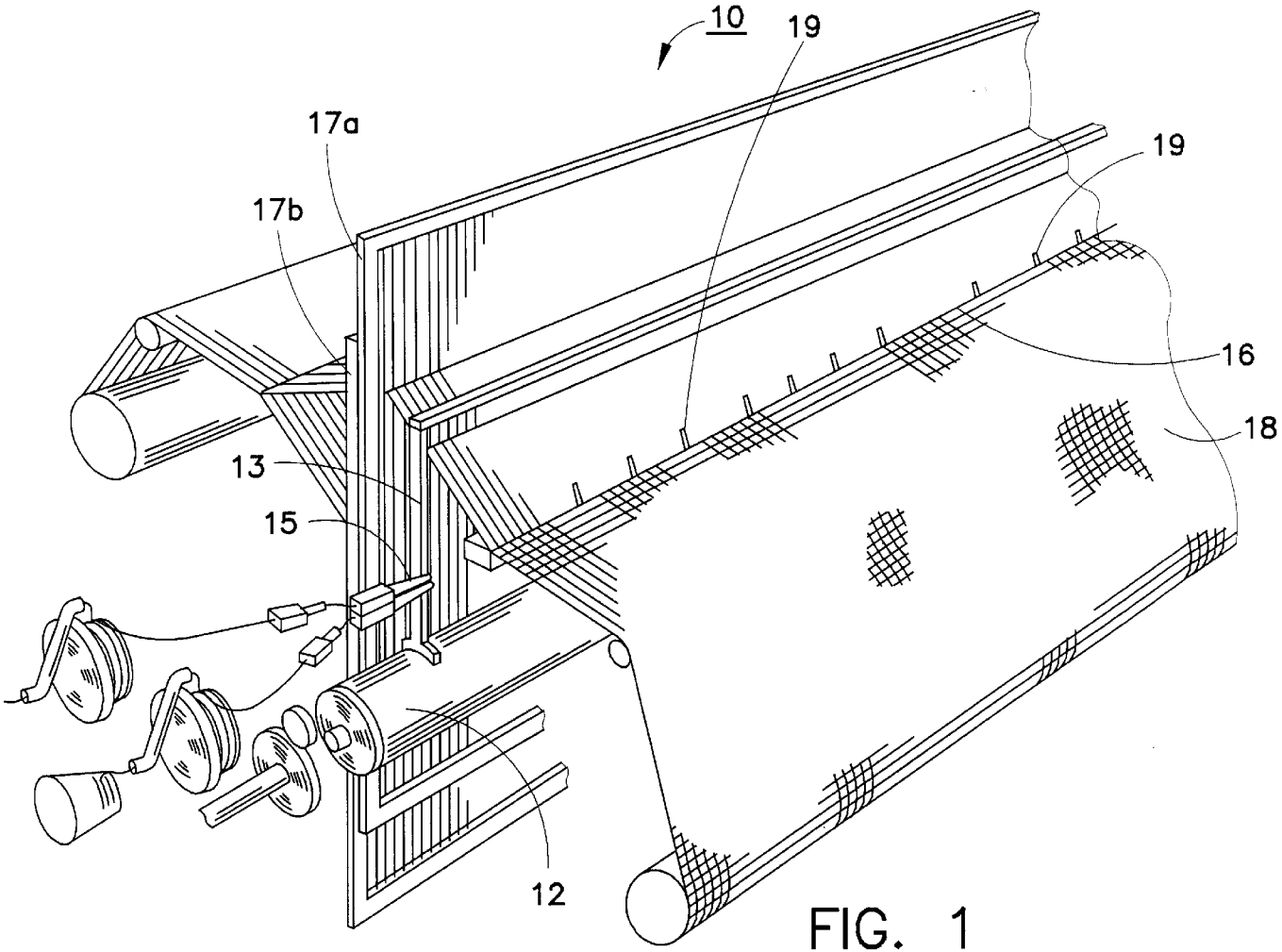
FIG. 1 is a front perspective view of an air jet loom manufactured by Picanol of the type for which the present invention is intended.

Referring now to FIG. 1, shown generally as 10 is an air jet loom that is representative of such looms known in the art and used in large numbers in the textile industry. The machine shown in FIG. 1 is manufactured by Picanol NV of Belgium as Model No. Omni-F-2-P. This loom, which is typical of air jet looms in the art, includes a pivotal sley shaft 12, a reed 13 mounted on the sley shaft 12, and at least one air jet main nozzle 15 for firing fill yarns against the fell line 16 of the fabric 18 being woven. As those skilled in the art understand, the fill yarns are those yarns that are parallel to the reed and extend across the width of the reed. In this air jet loom, fill yarns are fired across the warp beam (perpendicular to the reed) through the shed of the loom. A plurality of auxiliary nozzles 19 are arranged along the sley shaft 12 in front of the reed 13 in the shed. As used herein, the "shed" refers to a path through and perpendicular to the warp in the loom, and is formed by raising some warp threads by means of a harness while others are held down by another harness. These auxiliary nozzles, commonly known in the art as "shower head" nozzles, assist in transporting the fill yarn across the loom in a straight path. Once the fill yarn reaches the opposite side of the loom, it is detected by a feeler head or electronic eye and beaten up against the fell line 16 by reed 13. In a 1×1 weave pattern, each fill yarn is beaten up and then locked into the weave as the harnesses 17*a* and 17*b* of the loom cross to close, locking in the completed weave pattern, and then reopen a new shed for a subsequent. identical pattern.

Figure 2:
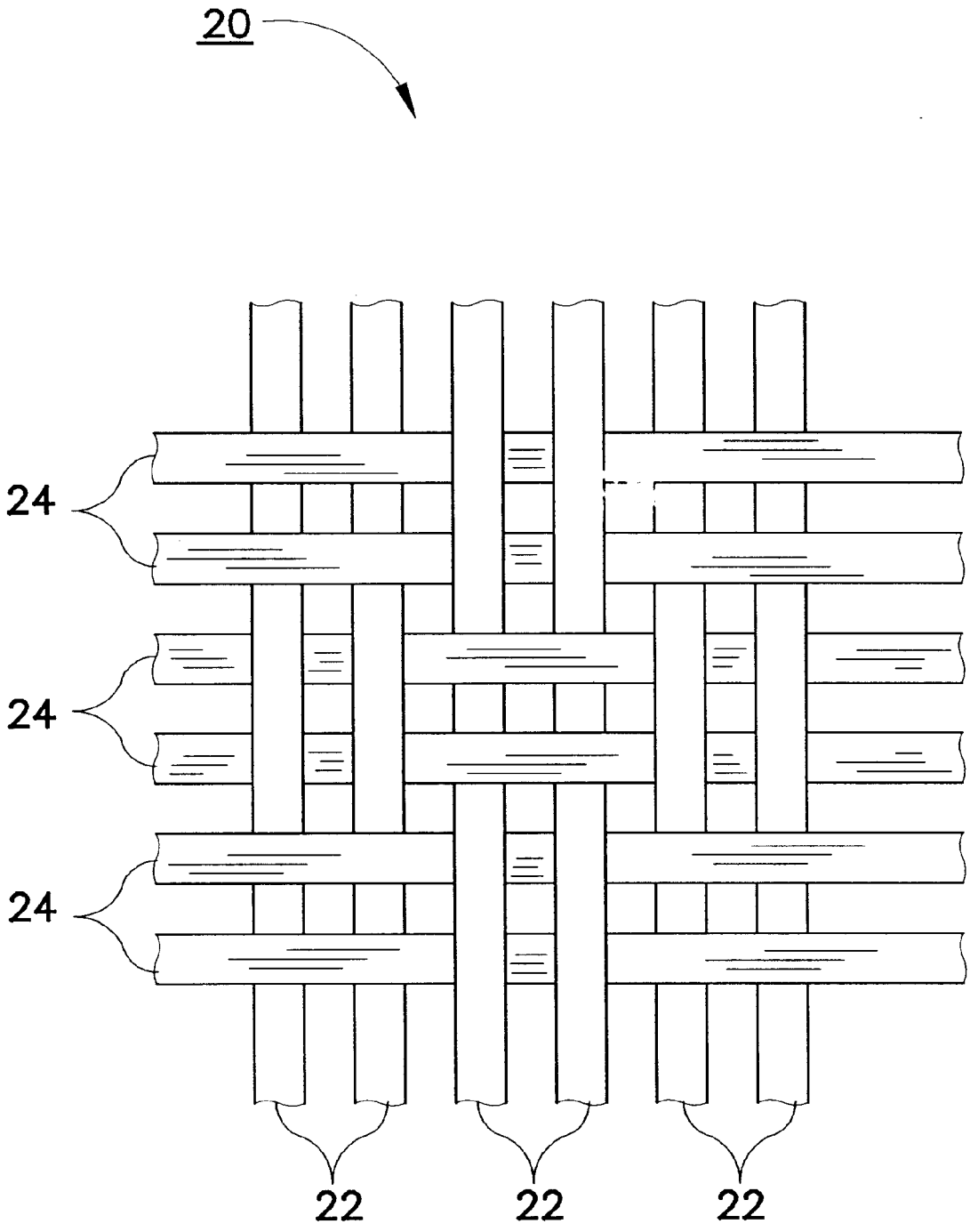
FIG. 2 is a schematic illustration of a conventional 2×2 basket weave pattern.

Depending upon the setup and programming of the individual loom, numerous weave patterns and types of yarn may be used. One such fabric pattern that is used in construction of luggage, sails, etc. is known as a "basket weave". Shown in FIG. 2 as a 2×2 example, a basket weave is a variation of a plain (1×1) weave, in which two or more warp and two or more fill yarns are woven side by side to resemble a plaited basket. In the 2×2 weave shown in FIG. 2, pairs of warp yarns 22 are woven side by side and pairs of fill yarns are shown woven side by side (in an exploded view) to create woven fabric 20. To create a 2×2 weave, for example, a first fill yarn is fired across the open shed. Reed 13 pivots forward on the rotable sley 12 to beat the first fill yarn against the fell line. This operation is conventional and well known in the art. As the reed 13 retreats rearward away from the fell line, there is a tendency for the first fill yarn to "pull-back" with the reed. As this occurs, the second fill yarn of the basket weave is fired across the loom, crossing over the first fill yarn. Reed 13 again beats up, and harnesses 17*a* and 17*b* cross, locking the distorted weave into the woven fabric 18.

Figure 3B:
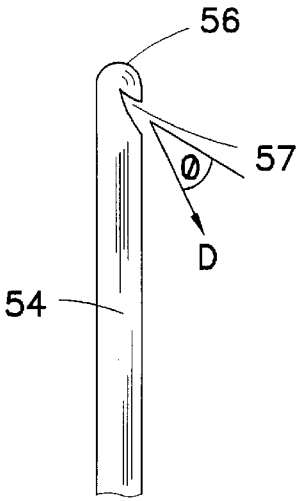
FIG. 3B is a side view of the air tube of the present invention.
Figure 3A:
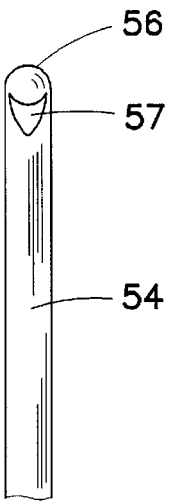
FIG. 3A is a front view of the air tube of the present invention.
Figure 3:
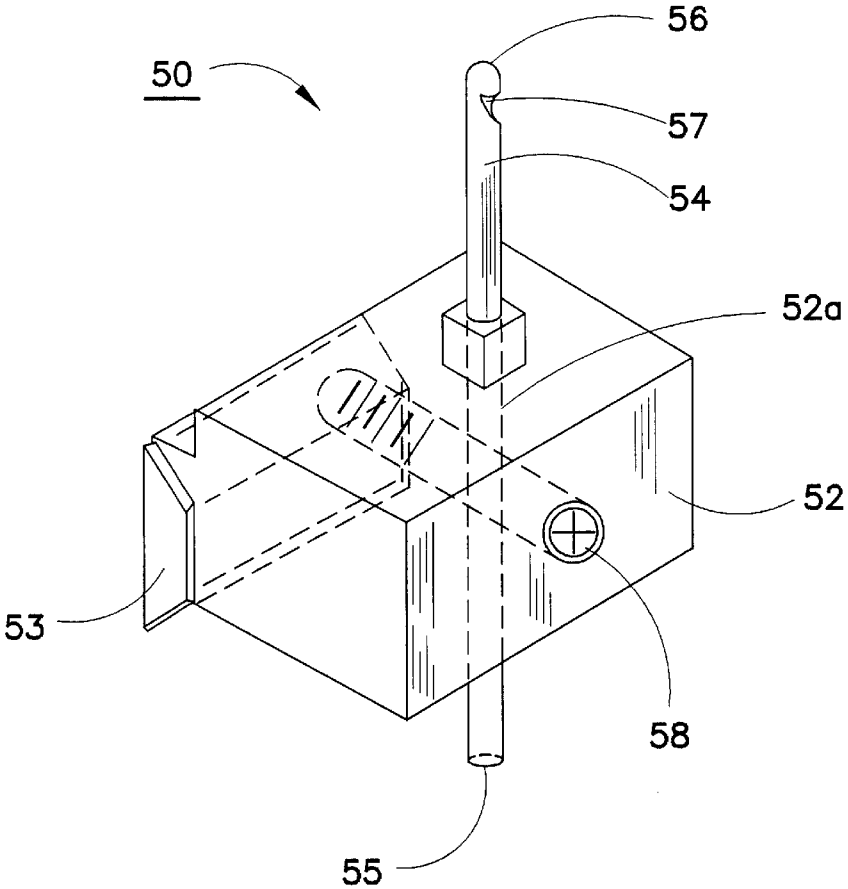
FIG. 3 is a front perspective view of the holding nozzle of the present invention.
Figure 4:
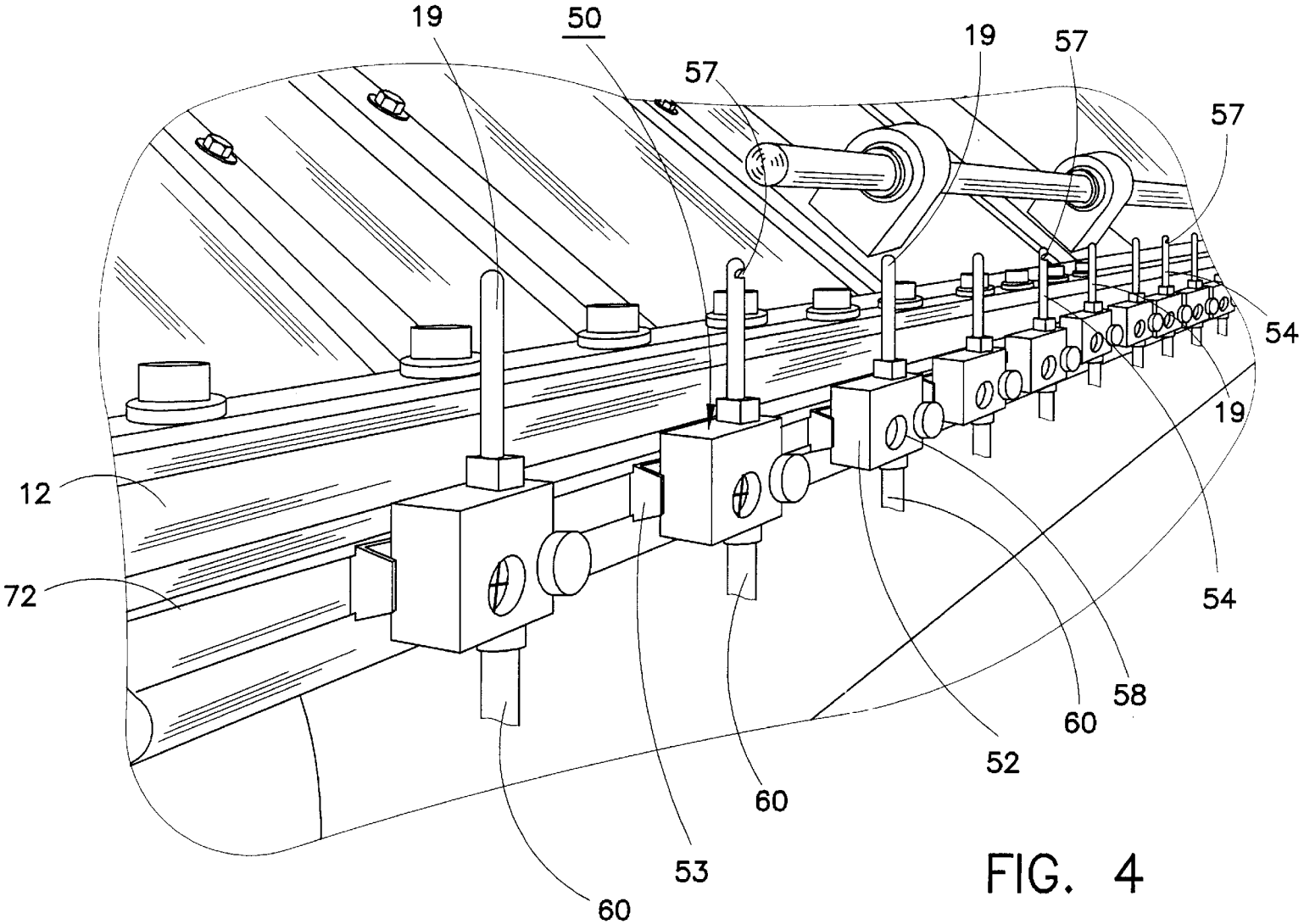
FIG. 4 is a side perspective view of the air jet loom of FIG. 6 (without yarns) demonstrating the operation of the holding nozzle of the present invention.

Referring now to FIGS. 3 and 4, a preferred embodiment of the holding nozzle of the present invention is shown generally as 50. This embodiment includes a tube holder 52 and an air tube 54. The tube holder shown here is illustrative of one of an unlimited number of shapes in which it may be formed. The tube holder 52 need only provide a mounting platform for the tube 54 and be adaptable for attachment within the shed of the loom. On the Picanol loom of FIG. 1, the tube holder 52 is adapted to fit on a track 72 formed in sley shaft 12. FIG. 4 (shown with yarn and fabric removed) best illustrates the placement of the tube holder 52 in track 72. For ease of construction, tube holder 52 is substantially identical to the tube holders used for the auxiliary nozzles 19, also mounted in track 72. Those skilled in the art will appreciate that there are numerous other ways for mounting the tube holder 52 on sley shaft 12. For the Picanol track 72, a tightening device 53 is provided to securely fasten the tube holder 52 to track 72. A fastener 58 is provided for loosening and tightening the tube holder 52 with tightening device 53 in track 72. Fastener 58 is threaded so that as it is turned either counterclockwise or clockwise, it either loosens or tightens, respectively, tightening device 53.

In a preferred embodiment, a slot 52*a* is formed completely therethrough tube holder 52 for positioning of the tube 54 therein. As shown in FIG. 3, tube 54, which is desirably formed as a single piece, has an air intake end 55, a closed end 56, and a discharge aperture 57 formed at some point along the length of tube 54. Discharge aperture 57 is so formed in tube 54 that it is directed toward fell line 18. It has been found that where the tube 54 has the same length as auxiliary nozzles 19; i.e., approximately 0.75 inches, the discharge aperture is most effective when formed as a horizontally oriented oval notch in the face of tube 54. FIGS. 3A and 3B are illustrative front and side views of tube 54 with aperture 57 formed therein. The oval shape is best seen in FIG. 3A, and the downward orientation of the discharge aperture is best seen in FIG. 3B. It has been found that the discharge angle, Θ, in the direction of Arrow D is optimally about 30 degrees; however, this angle may be varied depending upon the length of tube 54, the relative location of aperture 57 along the length of tube 54, and the mounting location for holding nozzle 50 within the shed of the loom.

Referring again to FIGS. 4 , there is shown the proper placement of the holding nozzle 50 on the sley 12 of a Picanol air jet loom. The holding nozzle 50 is positioned on the sley shaft 12 between two auxiliary nozzles 19, although there is no requirement that the holding nozzle 50 and auxiliary nozzles 19 be arranged in any particular configuration. Rather, it is only important that the holding nozzles 50 be positioned so that they most effectively discharge against the fell line with sufficient coverage to hold the length of the fill yarn against the fell line. It has also been found that on the Picanol loom described herein, three holding nozzles 50 are sufficient. As is conventional installation and operation with air jet looms, nozzles 19 and 50 receive compressed air through pneumatic hoses 60 connected to the open bottom ends of the nozzles (shown in FIG. 3 as 55 on nozzles 50). The pneumatic hoses originate at an air plenum (not shown) that not only supplies air to the nozzles, but also drives the operating mechanisms of the air jet loom, based on a programmed sequence of air solenoid (not shown) openings and closings.

Figure 5:
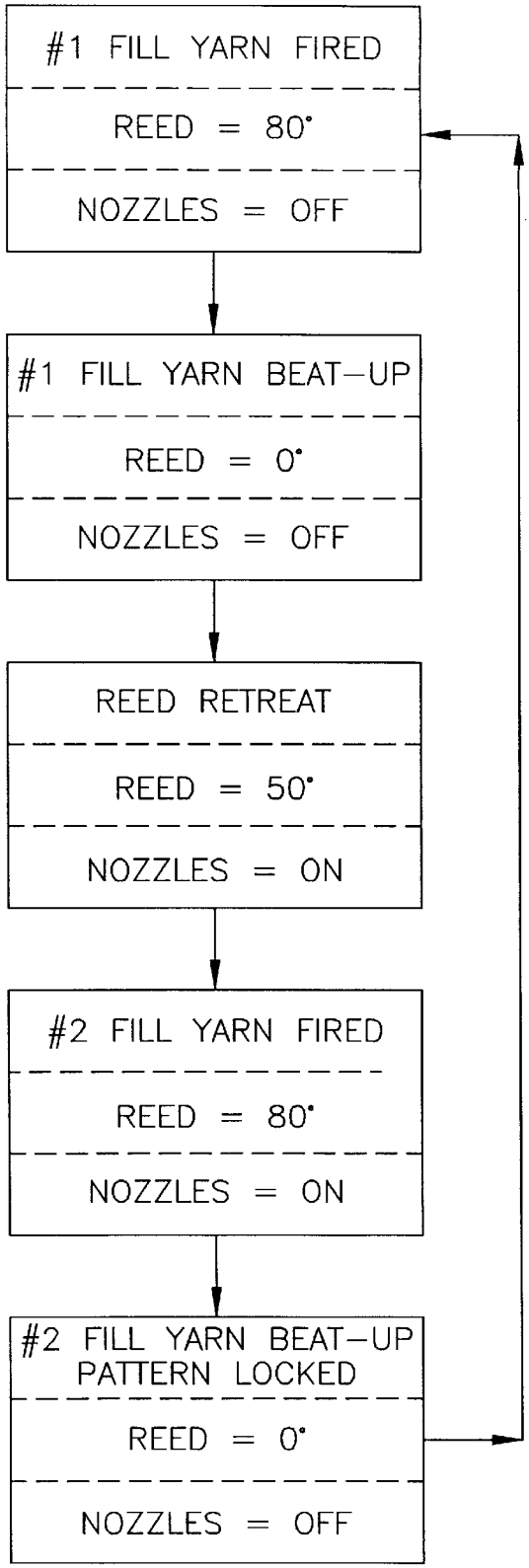
FIG. 5 is a block diagram illustrating one nozzle control pattern for the holding nozzles to effect the basket weave pattern according to the present invention.
Figure 6A:
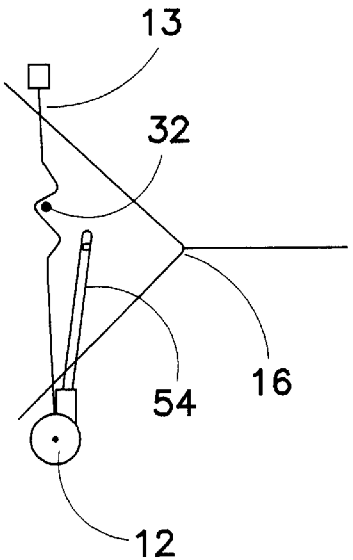
FIGS. 6A through 6E schematically illustrate the sequence of FIG. 5.
Figure 6B:
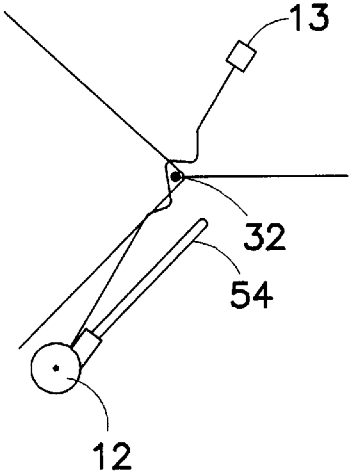
Figure 6C:
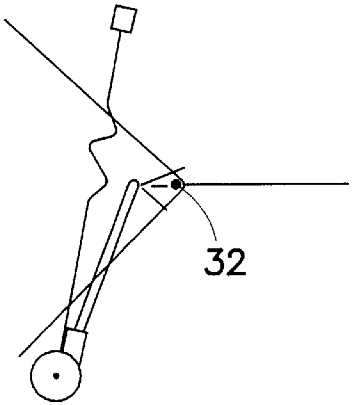
Figure 6D:
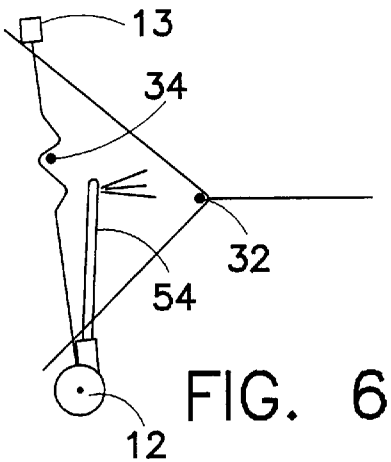
Figure 6E:
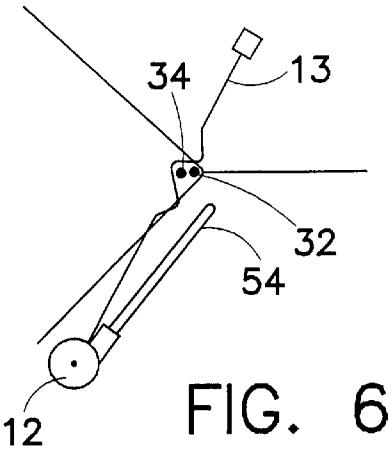

In the weaving art, the range of travel of the reed 13 pivotally about the sley shaft 12 is typically stated in degrees. When the reed is forward against the fell line, it is said to be at zero degrees. When completely rearward, the reed is said to be at 180 degrees. The reed moves continuously back and forth between these two positions. It has been found that the programmed sequence described herein provides a uniform basket weave pattern. FIGS. 5 and 6 illustrate the operation of the present invention viewed in light of a complete weaving cycle. FIG. 5 is a block flow diagram of the weaving cycle with the present invention incorporated therein, and FIGS. 6A through 6E graphically illustrate the relative location of the components of the loom during the weaving cycle. To begin the cycle (FIG. 6A), a first fill yarn 32 is fired when the reed 13 is at approximately 80 degrees and moving rearward. The holding nozzles 50 of the present invention are OFF. The reed 13 then moves forward (FIG. 6B) to beat fill yarn 32 against the fell line 16, or at the zero degree position. Nozzles 50 are still OFF. As reed 13 retreats rearward, the holding nozzles 50 are turned ON and begin operating when the reed 13 is at approximately 50 degrees (FIG. 6C), discharging air toward the fell line 16 to hold yarn 32 in place. The reed 13 continues its rearward movement and the second fill yarn 34 is fired when the reed 13 is at approximately 80 degrees (FIG. 6D). Nozzles 50 remain ON and continue to discharge as reed 13 against moves forward to the fell line (zero position) for the second beatup (FIG. 6E). At this time, the harnesses 17*a* and 17*b* cross, locking in the weave pattern. Nozzles 50 are turned OFF. The process is thus continuously repeated.

Certain modifications and improvements will occur to those skilled in the art upon a reading of the foregoing description. It should be understood that all such modifications and improvements have been deleted herein for the sake of conciseness and readability, but are properly within the scope of the following claims.

We claim:

1. A fill yarn holding apparatus for use on an air jet loom of the type used for weaving certain fabric patterns wherein each pattern has at least two fill yarns introduced between each harness reciprocation, and including a pivotal sley shaft, a reed mounted on the sley shaft, at least one air jet main nozzle for propelling fill yarns across the length of the reed, wherein after the reed beats the successive fill yarns against the fell line of the fabric being woven, the harnesses cross to lock in the weave pattern, comprising:

(a) at least one holding air nozzle, the holding air nozzle mounted on the sley shaft of the loom;

(b) said holding air nozzle having an opening so formed and positioned that, when operated, directs a jet of air against the previously laid fill yarn transversely to the path of the fill and toward the fell line; and (c) wherein when the at least one air jet propels a fill yarn, the holding air nozzle operates at a selected time to discharge air against the fell line to hold the fill yarn in place until the reed beats up to create a uniform weave pattern.

2. The fill yarn holding device of claim 1 wherein each of the holding air nozzles comprises:

(a) a tube holder; and (b) a tube, said tube positioned in said holder and having an air intake end, a closed end, and a discharge aperture formed at a selected point along the length of the tube.

3. The fill yarn holding device of claim 2 wherein the tube holder is adapted to be mounted on the sley shaft of the loom.

4. The fill yarn holding device of claim 2 wherein the aperture of said tube directs air downward at an angle of between about 30 degrees and 60 degrees with respect to the horizontal.

5. The fill yarn holding device of claim 1 wherein the holding air nozzle begins to discharge air after the reed beats up a first fill yarn and continues to discharge air until the reed beats up any remaining fill yarns that form the uniform weave pattern.

6. An air jet loom for forming a basket weave fabric, comprising:

(a) a sley shaft;

(b) a reed mounted on the sley shaft;

(c) at least one air jet main nozzle for propelling fill yarns in a path across the length of the reed in the shed of the loom, the reed beating the fill yarns against the fell line of the fabric after each fill yarn is propelled;

(d) at least one holding air nozzle positioned in the shed and having an aperture that directs a jet of air transversely to the path of the fill yarns wherein when the at least one air jet propels a second fill yarn, the aperture discharges air against the fill yarn to hold the second fill yarn in place until the reed beats up and the harnesses cross over to prevent intermingling of the first and second fill yarns; and (e) an air control system for activating and deactivating the air jet and holding air nozzles at the designated times.

7. The air jet loom of claim 6 wherein said holding air nozzle comprises:

(a) a tube holder; and (b) a tube, said tube positioned in said holder and having an air intake end, a closed end, and a discharge aperture formed at a selected point along the length of the tube.

8. The air jet loom of claim 7 wherein the tube holder is adapted to be mounted on the sley shaft of the loom.

9. The air jet loom of claim 7 wherein the aperture of said tube directs air downward at an angle of between about 30 degrees and 60 degrees with the long axis of the tube.

10. A method for creating a basket weave fabric on an air jet loom, comprising:

(a) firing a first fill yarn;

(b) operating the reed to beat up the first fill yarn against the fell line;

(c) at a designated time during the operation of the reed to beat up the first yarn directing a stream of air perpendicular to the fell line against the first fill yarn to hold the first fill yarn in place;

(d) firing at least a second fill yarn;

(e) beating up at least a second fill yarn and releasing the stream of air against the first fill yarn; and operating the harnesses to lock the at least two fill yarns in place.

11. The method of claim 9 wherein the air stream is directed against the first fill yarn following the beating up by the reed of the first fill yarn and continuing through the beatup of the at least a second fill yarn.

* * * * *